United States Patent [19]

Racinet

[11] Patent Number: 4,524,570

[45] Date of Patent: Jun. 25, 1985

[54] BLANKET-SADDLE FOR SPORTING HORSE-RIDING

[76] Inventor: Jean-Claude Racinet, 174, Avenue Charles de Gaulle, 92200 Neuilly, France

[21] Appl. No.: 494,716

[22] Filed: May 16, 1983

[51] Int. Cl.[3] ..... B68C 1/02; B68C 1/12

[52] U.S. Cl. ..... 54/44; 54/46; 54/66

[58] Field of Search ..... 54/35, 41, 44, 46, 65, 54/66, 79

[56] References Cited

U.S. PATENT DOCUMENTS

| | | | |
|---|---|---|---|
| 340,892 | 4/1886 | Newman | 54/46 |
| 439,353 | 10/1890 | Jones | 54/66 |
| 530,864 | 12/1894 | Torrey | 54/66 |
| 749,358 | 1/1904 | Brooke | 54/46 |
| 3,371,467 | 3/1968 | Salisbury | 54/44 |

FOREIGN PATENT DOCUMENTS

| | | | |
|---|---|---|---|
| 13634 | of 1897 | United Kingdom | 54/65 |

*Primary Examiner*—Robert P. Swiatek

*Attorney, Agent, or Firm*—Gottlieb, Rackman & Reisman

[57] ABSTRACT

The seat-tree is provided on its lower face with an anatomical padding made from a material which is both supple and resistant, adapted to the back of the horse and filling the space between the tree and the back of the animal over the whole length of the tree situated directly below the rider, a central recess being formed at right angles to the animal's backbone; advantageously, each lateral V shaped half-girth has one end fixed to a tree-leg and its other end secured by buckles to tabs fixed approximately in the middle of the side edge of the tree; a supple and light flap, thin without being easily creased, may be fixed to the tree on each side so as to cover approximately the upper half of the V shaped half-girth and the saddle-blanket may have, at the front of each of its lateral sections and immediately beyond the flap, a thick external padding made from a soft and supple material. This blanket-saddle is especially adapted for jumping, while being suitable for all kinds of horse-riding.

7 Claims, 7 Drawing Figures

BLANKET-SADDLE FOR SPORTING HORSE-RIDING

BACKGROUND OF THE INVENTION

The present invention relates to a blanket-saddle intended more particularly for sporting horse-riding.

In this kind of horse-riding, it is desirable for the rider to be integral with his horse and to be consequently kept away from the horse's body as little as possible by the saddle, this latter however being useful for the comfort of the rider and of his horse and to allow stirrups to be used.

However, conventional saddles are provided laterally with panels, false flaps and flaps whose purpose is to protect the rider's legs from the buckles of the girth holding the saddle in position on the horse, but which form a stiff shield of relatively great thickness between the rider's legs and the horse, which is particularly unfavorable in sporting riding.

To palliate these disadvantages, the applicant has already designed a blanket-saddle, formed by a saddle blanket made in two parts for placing on each side of the horse and joined by screws or other equivalent means to a rigid one-piece seat-tree which is free of the usual above-mentioned lateral fittings (see French Pat. No. 2 353 482 filed on June 3, 1976). This blanket-saddle is equipped with a special girthing device comprising, on each side of the seat tree, a half girth, one end of which is fixed to the front of the tree, under the stirrup-leather holder, which passes through a ring fixed to one end of a belly strap and which is fixed by means of buckles to tabs fixed to the rear of the saddle tree, the belly strap being provided with a second ring at its other end for passing the second half girth therethrough, identical to the first one and mounted in a similar fashion on the opposite side of the seat-tree. The girthing is adjusted by causing the two half-girths to slide, which have each a V shape, in said rings of the belly strap. Since the tab holders are fixed to the seat-tree, towards the rear thereof, so behind the rider's thighs, the rider may easily adjust the girth without getting off the horse, by sliding the two V shaped half-girths in the rings of the belly strap, and he is in particular not hindered by the tangs of the buckles of the half-girths, connecting these latter to the tabs, because this system for buckling the half-girths is placed behind his legs and not thereunder; for this reason, the usual protection means, panels, false flaps and flaps become superfluous; there only remains the blanket which is made from a relatively supple material and which is useful for protecting the rider and the saddle from the sweat of the horse.

SUMMARY OF THE INVENTION

The aim of the present invention is to improve this known construction, so as to allow the rider to form more readily one with his horse and to have an even more precise riding position, which is mainly desirable for jumping and horse shows.

To this end, the present invention provides a blanket-saddle, comprising a one-piece rigid seat-tree placed on a saddle blanket and a girthing device formed of two V shaped lateral half-girths, one end of which is fixed to the front of the tree and the other end of which is connected by securing buckles to tabs fixed towards the rear of the tree, the two half-girths being associated with a belly strap having a buckle at each of its ends and each half girth passing through one of the buckles, in which it may slide for adjusting the girthing, said blanket saddle being provided on each side with a stirrup-leather holder fixed to the front of the tree.

This blanket-saddle is characterized in that the seat-tree is provided, on its lower face, with anatomical padding, morphologically adapted to the horse's back and filling the space between the tree and the back of the horse, over the whole length of the tree situated straight below the rider, so as to better distribute the weight of this rider over the animal and to ensure correct balance of the saddle as well as a perfect connection between the back of the animal, the saddle and the rider, a central recess being however formed at right angles to the backbone of the animal. The seat-tree, in the usual construction, is accompanied with padding panels which are not necessarily adapted to the shape of the horse's back; the result is that this seat-tree bears more particularly at four points on the animal's back, which in most cases introduces a constraint for this latter. With this distribution improved with the shaped padding of the invention, the animal is more at ease and can more readily carry out the exercises which are imposed on him, for jumping for example.

The padding is made from a material, both supple and resistant, such as horsehair, wool, felt, a natural or synthetic elastomer foam, for example a polyether, polyurethane, polyethylene or similar foam, or a mixture of these different substances.

The seat-tree may be formed from a conventional wood or metal tree with leather covering; it may also be molded in one piece from a plastic material of sufficient rigidity, with or without a leather covering.

The shaped padding, placed under the tree, is protected by a supple, natural or synthetic leather covering or a covering made from any other material having the same qualities of flexibility, resistance and hygiene as natural leather, for example a solid woven material made from natural or synthetic fibers.

Also in accordance with the invention, the lateral V shaped half-girths are advanced a little over the tree, one end of the half-girth being fixed to the leg of the tree and the tabs to which the other end of the half leg is fixed being secured approximately to the middle of the corresponding side edge of the tree. Thus, the tip of the V shaped half-girth is situated approximately on the vertical of the stirrup-leather and that provides a better balance of the saddle, which may further improve the performances of the horse and of the rider. Furthermore, with the girthing fixed to the legs of the tree, it pulls on these latter and so tends to prevent said legs from moving apart under the weight of the rider, which could cause injury to the withers of the animal.

The belly strap is preferably of a length adjustable by any appropriate means, so as to be adaptable to the corpulence of the animal.

Although the tabs are advanced, they are however still situated behind the thigh of the rider, who is then not hindered and who may still readily modify the adjustment of the girthing, without getting off the horse. However, with this new position of the half-girths, the rider risks rubbing against the securing buckles and tearing his clothes when he gets off the horse. To get over this disadvantage, the new saddle may be equipped on each side with a light and supple flap, thin without being easily creased, which is fixed to the tree so as to cover approximately the upper half of the V shaped half-girth, this flap having substantially rectilinear edges at the front and at the rear where it does not substantially extend behind the tabs. With this flap, which in all cases must be flexible and which may be made from felt or thin and supple leather, for example calfskin, girthing behind the thigh, i.e. while remaining in the saddle, is always possible.

The saddle blanket used is made from a single piece and its dimensions are such that it extends beyond the saddle equipped with its flexible flaps, over the whole periphery thereof. In accordance with the invention, the saddle blanket has at the front of each of its two lateral sections, in the region extending beyond the flap with substantially rectilinear front edge and over the whole height of this flap, a thick outwardly projecting padding, this padding being made from a soft and flexible material and being intended to form, at the front of the flap, a soft housing for the rider's knee, particularly when jumping and more generally when riding with short stirrup-leathers.

In conventional saddles, pads may exist on the front edge of the flaps, but these pads are stiffer and harder, they are less comfortable and they often hinder the forward movement of the rider's knee, which disadvantage is removed with the paddings of the invention.

According to the present invention, the padding of each lateral section of the saddle blanket abuts with its rear part against the front edge of the corresponding flap and forms a soft housing for the knees; the knee may advance at the moment of jumping, it does not meet any rigid obstacle, which allows easy movements and a so-called deep seat; the rider does not need to perform acrobatics for jumping, as is often the case with conventional saddles.

The paddings of this saddle blanket may be made from wool, or a soft and flexible foam of the polyether, polyurethane, polyethylene or similar foam kind. The suppleness of the padding must be calculated so that at no time can the forward movement of the knee of the rider be hindered and precisely at the time of a jump, when the knee is projected forwardly.

The saddle blanket may be made from sheepskin, or any other skin, or from wool or from any other suitable material and it is made in a double thickness for housing the padding.

These paddings, whose cross section is approximately oval or ellipsoidal, bear on the rear region of the shoulder blades of the horse.

The blanket-saddle of the invention does away with the rigid structures which are a hindrance both for the animal and for the man.

This blanket-saddle is specially adapted for jumping, particularly at horse shows, but it is however advantageous for all types of horse-riding. Thus, for training purposes, where long strirrup-leathers are used, it will be used with a normal saddle blanket without padding. For cross country and eventing, where the jumps are less vertical and where the rider is more likely to fall, it will be used with a saddle blanket having a greater projection at the front and having in this front region firmer external pads.

BRIEF DESCRIPTION OF THE DRAWINGS

A particular embodiment of the blanket-saddle of the invention will be described hereafter, by way of example which is given purely as indication and is in no wise limiting, with reference to the accompanying drawings in which.

DESCRIPTION OF THE PREFERRED EMBODIMENT

Figure 1:
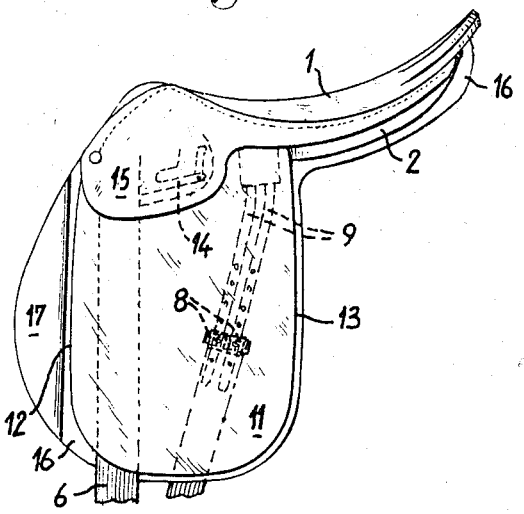
FIG. 1 is a side elevational view of the blanket-saddle.
Figure 2:
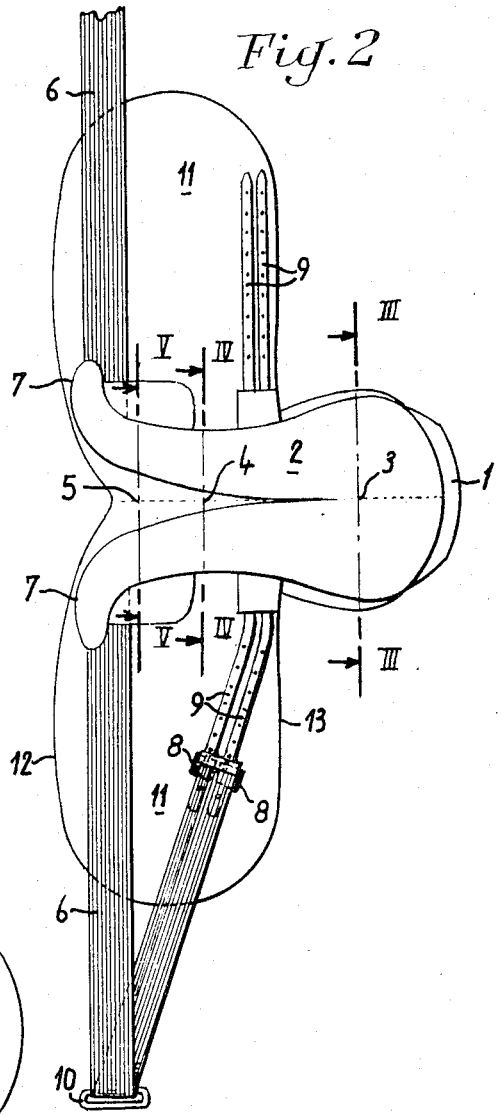
FIG. 2 is a bottom view of the saddle opened out, the saddle blanket being omitted.
Figure 5:
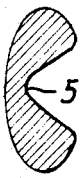
FIGS. 3 to 5 are schematic views in cross section of the seat-tree, respectively along lines III—III, IV—IV and V—V of FIG. 2.
Figure 4:
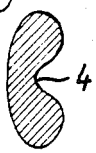
Figure 3:
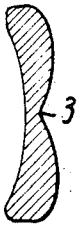

In FIGS. 1 and 2 can be seen a seat-tree 1 made from wood and metal and covered with leather, which has the characteristic of further comprising on its lower face, a padding 2, preferably in the form of a polyether foam with a soft leather covering. This padding is anatomical, i.e. it has a thickness and a shape such that its lower face rests on the back of the horse, whose morphology it reproduces, except in its central region, which is hollowed out as shown at 3, 4 and 5 in FIGS. 3 to 5, to leave the backbone of the animal free. The median hollow 5, situated above the withers of the horse, is deep and the depth of the hollow decreases (4 and 3) in the direction of the rear of the saddle. This shaped padding 2 distributes homogeneously the pressure of the rider on the back of the horse, when this rider is sitting in the saddle.

The girthing comprises a half-girth 6 on each side of the seat-tree 1. One end of the half-girth is fixed to the tree-leg 7, whereas the other end is fixed by means of tang buckles 8 to tabs 9, which are fixed in the middle region of the corresponding side edge of the tree. The half-girth 6 passes into a buckle 10, which is fitted to the end of a belly strap, not shown, having a similar buckle 10 at its other end for connection thereof with the second half-girth 6 and which is preferably of a length which is adjustable by any appropriate means. It can be seen that the half-girths 6 are in the shape of a V whose tip is at the level of ring 10.

On each side of the seat-tree, a flap 11 made from a supple and uncreasable material, such as thin leather, covers the half-girth 6 partially in height. This flap, fixed to the seat-tree 1, does not project beyond the tree legs at the front of the saddle and it has a front edge 12 and a rear edge 13 which are substantially rectilinear.

On each side of the saddle, a stirrup-leather holder 14 is embedded in the tree in the usual way and is hidden under a small flap 15 in a conventional way. It can be seen, looking at FIG. 1, that the tip of the V of the half-girth 6 is situated substantially in a vertical line with the stirrup-leather which will be fitted to the stirrup-leather holder 14.

Figure 6:
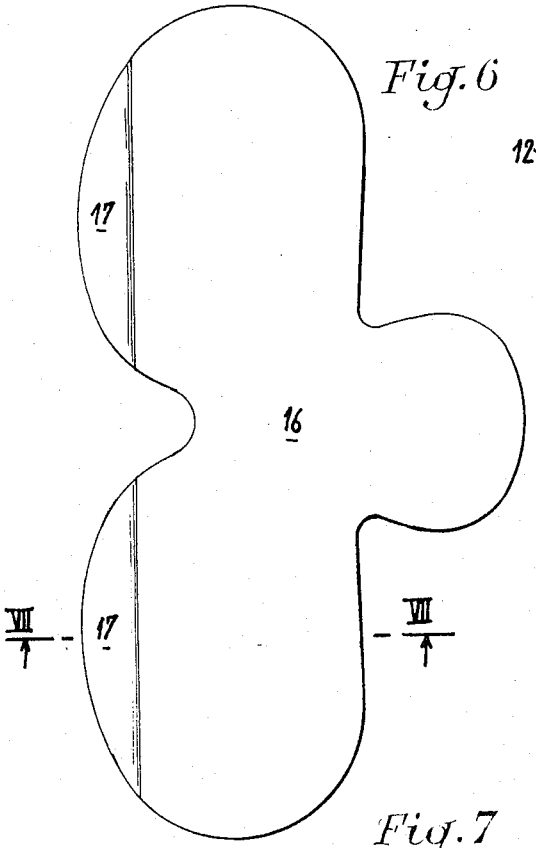
FIG. 6 is a top view of the saddle blanket opened out.
Figure 7:
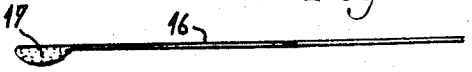
FIG. 7 is a sectional view along line VII—VII of FIG. 6.

A saddle blanket 16 is associated with the assembly formed by the seat-tree with its girthing device and its flaps. This saddle blanket 16, when opened out (FIG. 6), has the same general shape as said opened out assembly (FIG. 2), but with slightly greater dimensions, so as to extend beyond said assembly under which it is placed. Furthermore, this saddle blanket has a projection on the front edge of each of its lateral sections and each projection comprises an outwardly projecting padding 17, made preferably from wool or polyether foam, this padding having to be soft and supple. The padding is provided over the whole height of flap 11 (see FIG. 1) and it has a substantially oval or ellipsoidal section (see FIG. 7). It can also be seen in FIG. 1 that padding 17 is level with the front edge 12 of flap 11.

All the advantages of the particular structure of this blanket-saddle, specially designed for sport riding, have been indicated above. It should further be noted that, considering the restricted number of parts which go to form it, this saddle is light, which is another great advantage for sporting horse-riding.

Modifications of detail, within the field of technical equivalents, may be made to the above-described blanket saddle without departing from the scope and spirit of the present invention.

What is claimed is:

1. A blanket-saddle for sporting horse-riding, comprising a rigid one-piece seat-tree placed on a saddle blanket and a girthing device formed of two lateral V shaped half-girths, one end of which is fixed to the front of the tree and the other end of which is connected by securing buckles to tabs fixed towards the rear of the tree, the two half-girths being associated with a belly strap of adjustable length having a buckle at each of its ends and each half-girth passing through one of the buckles, in which it may slide for adjusting the girthing, said blanket-saddle having two lateral sections and being provided on each side with a stirrup-leather holder fixed to the front of the tree, wherein the seat-tree has on its lower face an anatomical padding, morphologically adapted to the back of the horse and filling the space between the tree and the back of the horse, over the whole length of the tree situated directly below the rider, so as to better distribute the weight of this rider over the animal and to ensure a good balance of the saddle as well as a perfect connection between the back of the animal, the saddle and the rider, a central recess being hoever formed at right angles to the backbone of the animal, the padding being made from a material which is both supple and resistant, a supple and light flap, thin without being easily creased, being fixed on each side to the tree so as to cover approximately the upper half of the V shaped half-girth, this flap having a substantially rectilinear edge at the front and at the rear, where it does not substantially extend beyond said tabs, the saddle blanket being made from a single piece having dimensions such that it extends beyond the saddle equipped with its supple flaps, over the whole periphery thereof, and said saddle blanket having only at the front of each of its two lateral sections, in the region extending beyond the flap with substantially rectilinear front edge and over the whole height of this flap, a thick outwardly projecting padding.

2. A blanket-saddle as claimed in claim 1, wherein said lateral V shaped half-girths are a little advanced over the tree, one end of the half-girth being fixed to a tree-leg and the other end of the half-girth being fixed to tabs which are secured approximately to the middle of the corresponding side edge of the tree, the tip of the V shaped half-girth being thus situated approximately vertically in line with the stirrup-leather.

3. A blanket-saddle as claimed in claim 1 or 2, wherein the paddings of the saddle blanket are made from a soft and supple material and are intended to form, at the front of the flap, a soft housing for the knee of the rider, at the time of jumping and when riding with short stirrup-leathers.

4. A blanket-saddle as claimed in claim 3, wherein the paddings of the saddle blanket are made from wool or from a natural or synthetic elastomer foam.

5. A blanket-saddle as claimed in claim 3, wherein the paddings of the saddle blanket have an approximately oval or ellipsoidal cross section.

6. A blanket-saddle as claimed in claim 1 or 2, wherein the saddle blanket has, in the front of each of its lateral sections, a substantial projection beyond the substantially rectilinear front edge of the flap and is provided, in this projecting region, with outwardly projecting pads having a certain firmness, in the case of cross country and event riding.

7. A blanket-saddle as claimed in claim 1, wherein said anatomical padding of the seat-tree is made of a material selected from the group consisting of horse-hair, wool, felt, natural and synthetic elastomer foams, and mixtures of these substances, and is protected by a coating made from a supple, resistant and hygienic material.

* * * * *